US007721466B2

(12) United States Patent
Guo

(10) Patent No.: US 7,721,466 B2
(45) Date of Patent: May 25, 2010

(54) SHOE SOLE AND INSOLE STRUCTURE

(76) Inventor: Cing-Yang Guo, P.O. Box 1-252, Sanchung (TW)

( * ) Notice: Subject to any disclaimer, the term of this patent is extended or adjusted under 35 U.S.C. 154(b) by 656 days.

(21) Appl. No.: 11/731,370

(22) Filed: Apr. 2, 2007

(65) Prior Publication Data

US 2008/0235986 A1 Oct. 2, 2008

(51) Int. Cl.
*A43C 13/00* (2006.01)
*A43B 13/20* (2006.01)
*A43B 13/38* (2006.01)
*A43B 7/06* (2006.01)

(52) U.S. Cl. ..... 36/43; 36/29; 36/3 B; 36/15

(58) Field of Classification Search ..... 36/15, 36/29, 3 B, 3 R, 100, 101, 43, 44
See application file for complete search history.

(56) References Cited

U.S. PATENT DOCUMENTS 2,090,881 A * 8/1937 Wilson ..... 36/29
2,183,277 A * 12/1939 Heilhecker ..... 36/14
3,538,628 A * 11/1970 Einstein, Jr. ..... 36/15
4,521,979 A * 6/1985 Blaser ..... 36/29
5,317,822 A * 6/1994 Johnson ..... 36/101
6,209,226 B1 * 4/2001 Squadroni ..... 36/3 B
6,389,712 B1 * 5/2002 Schelling ..... 36/15
7,225,491 B2 * 6/2007 Reed et al. ..... 12/142 P
2003/0230007 A1 * 12/2003 Walton ..... 36/15

* cited by examiner

*Primary Examiner*—Ted Kavanaugh

(57) ABSTRACT

A shoe sole and insole structure is disclosed. The sole comprises an upper sole and a lower sole; the lower sole has a plurality of through-holes thereon and includes a plurality of lock plugs inserted respectively inside the through-holes; the upper sole has the same number of lock bars on its undersurface. The upper sole directly laminates over the lower sole by inserting the lock bars into the through-holes and then securing the lock bars with lock plugs by inserting the lock plugs into the through-holes. The insole has a plurality of groove rings on its undersurface, each groove ring being disposed with a small through-hole, and further comprises a plurality of ladle discs respectively glued in the groove ring to form an insole with a plurality of air pockets.

7 Claims, 3 Drawing Sheets

SHOE SOLE AND INSOLE STRUCTURE

BACKGROUND OF THE INVENTION

1. Field of the Invention

The present invention relates to an improved shoes sole and insole structure, more particularly a kind of sole and insole structure that allows wearer to replace the sole at will and keeps the inside of shoes aerated and dry. In addition, it allows the right side or left side of the heel part of the sole to be raised to balance uneven wear at the right side or left side of the heel.

2. Description of the Related Art

The sole of footwear nowadays typically has a single-layer structure. When the sole is worn to a certain extent and needs to replaced, the sole and instep must be separated manually and a new sole is sewed or glued to the instep. Such sole replacement requires the work of a professional for regular consumers lack the tools to do their own repair. In addition, many shoes on the market nowadays come with a sole design to improve aeration and dryness. But sole design with such purpose typically has one or two air charging means at limited locations and with limited aeration area and quantity. Thus its aeration effect is not striking.

SUMMARY OF THE INVENTION

The object of the present invention is to provide a shoe sole and insole structure.

To realize the aforesaid object, in the shoe sole and insole structure provided herein, the sole comprises an upper sole and a lower sole; the lower sole consists of a plate body disposed with a plurality of through-holes spaced apart thereon and having a plurality of lock plugs respectively inserted into the through-holes; the upper sole consists of a plate body extendingly disposed on its undersurface with the same number of lock bars at places corresponding to the through-holes on the lower sole. The upper sole directly laminates over the lower sole, and each lock bar on the plate body of upper sole is respectively inserted into each through-hole on the plate body of lower sole. Each through-hole is then inserted with a lock plug to secure the lock bar to form a sole with readily replaceable lower sole.

In the shoe sole and insole structure according to the invention, the insole has a plate body disposed with a plurality of groove rings on its undersurface and having a small through-hole on the plate body at the center location of each groove ring and a plurality of ladle discs respectively glued in the groove rings to form an insole with a plurality of air pockets.

Each lock bar on the undersurface of the upper sole plate body of the sole is designed into a bar with a ball-shaped protrusion of larger diameter or protruding ring of larger diameter at the end. The lock plug is designed with a column having a transverse through hole thereon and a cylindrical pit is configured at the center of the uppersurface of column, which communicates with the transverse through-hole. As such, the lock bar is inserted into the cylindrical pit on the uppersurface of the lock plug column and secured at the transverse through-hole.

The marginal edge of the ladle disc is disposed with a plurality of convex rings of different heights. The through-holes on the lower sole plate body are designed as tapered through-holes that are big at the top and small at the bottom. The column of lock plug is designed as a tapered column that is big at the top and small at the bottom.

The embodiment of the invention allows consumers to replace the sole by themselves, and balance the uneven wear at the left side or right side of the heel. When worn, the invention is fully charged with air inside that keeps the shoes fully aerated and keeps the feet of the wearer dry and comfortable.

DETAILED DESCRIPTION OF THE PREFERRED EMBODIMENT

Figure 1:
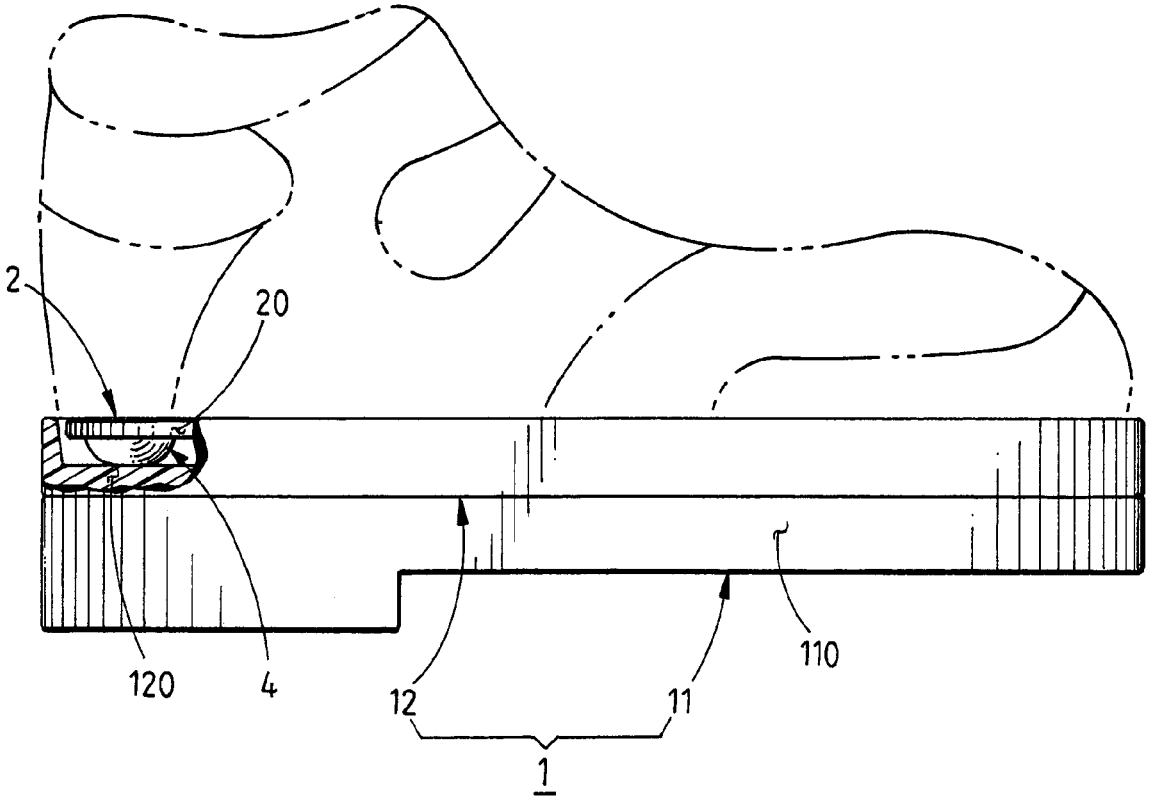
FIG. 1 shows a side view and partial vertical section of the invention assembled with an instep.
Figure 2:
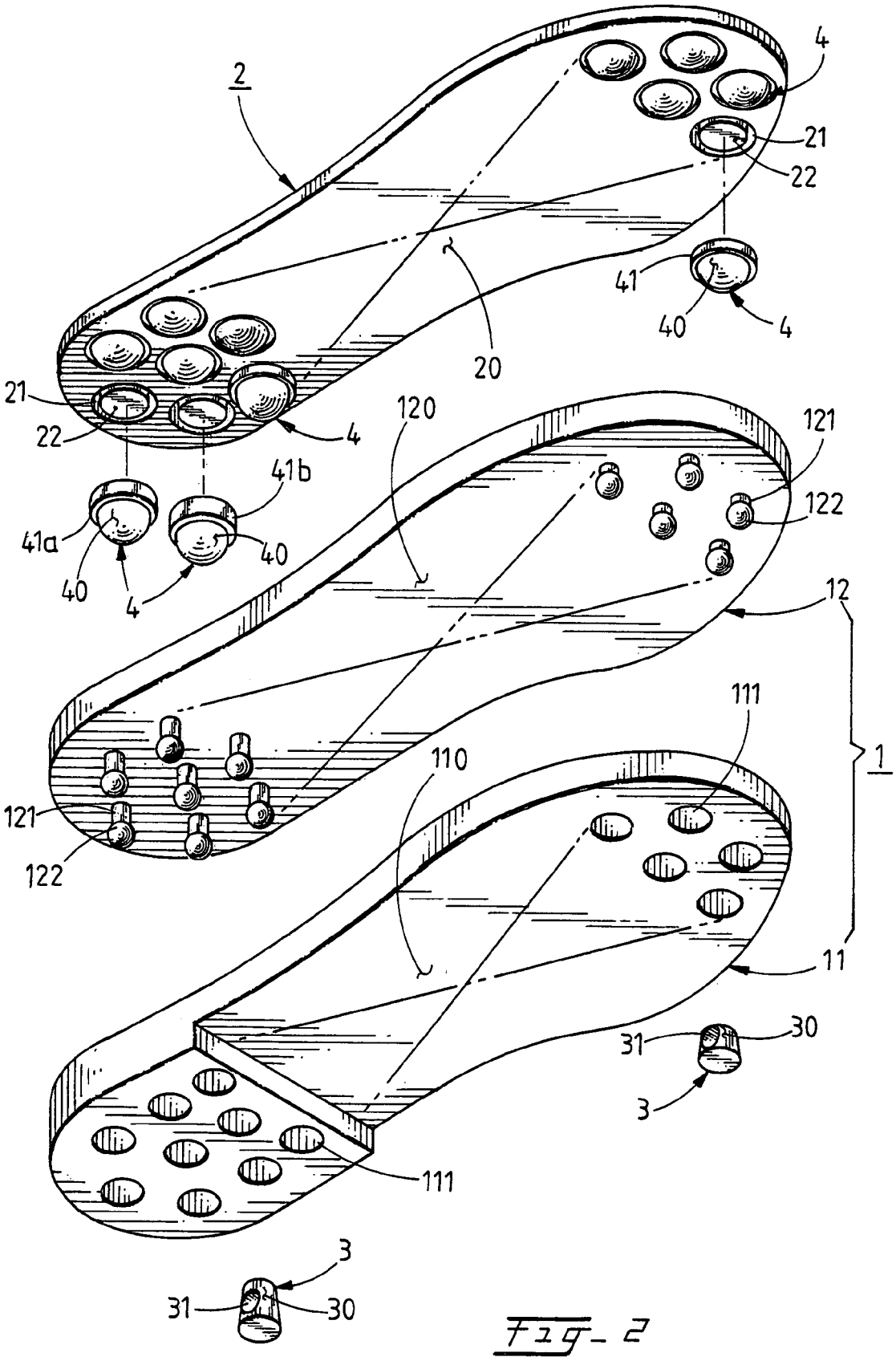
FIG. 2 is an exploded view of the invention viewed from the bottom.
Figure 4:
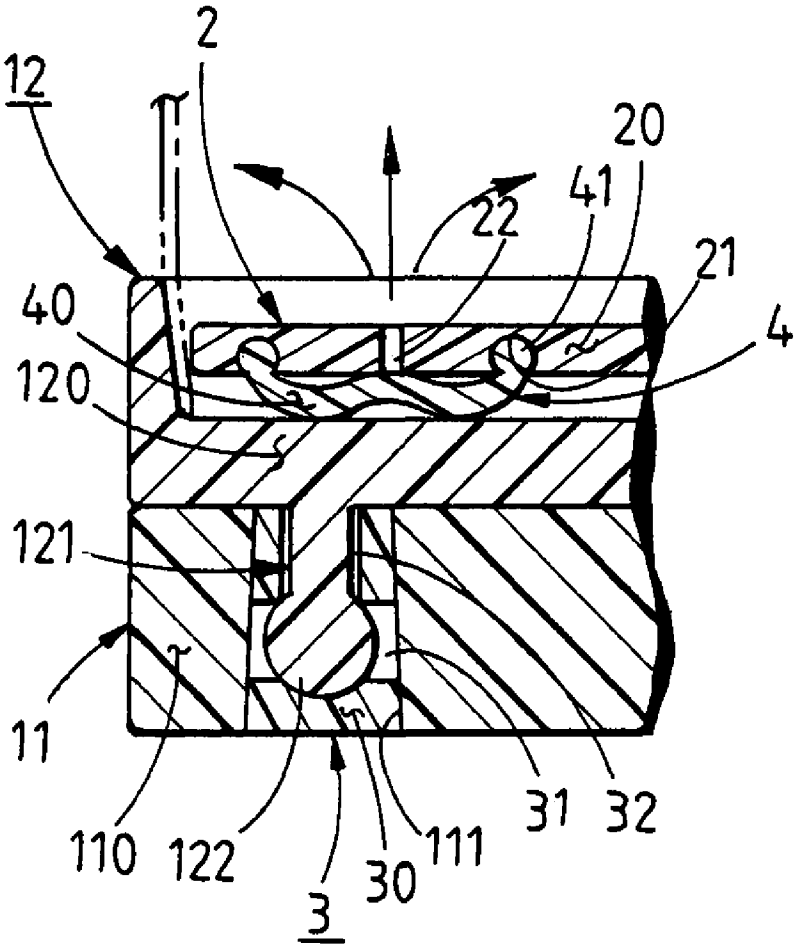
FIG. 4 is a magnified view showing the vertical section of the part of upper sole and lower sole locking to each other and the part of ladle discs of insole, and the diagram of insole performing air suction.
Figure 3:
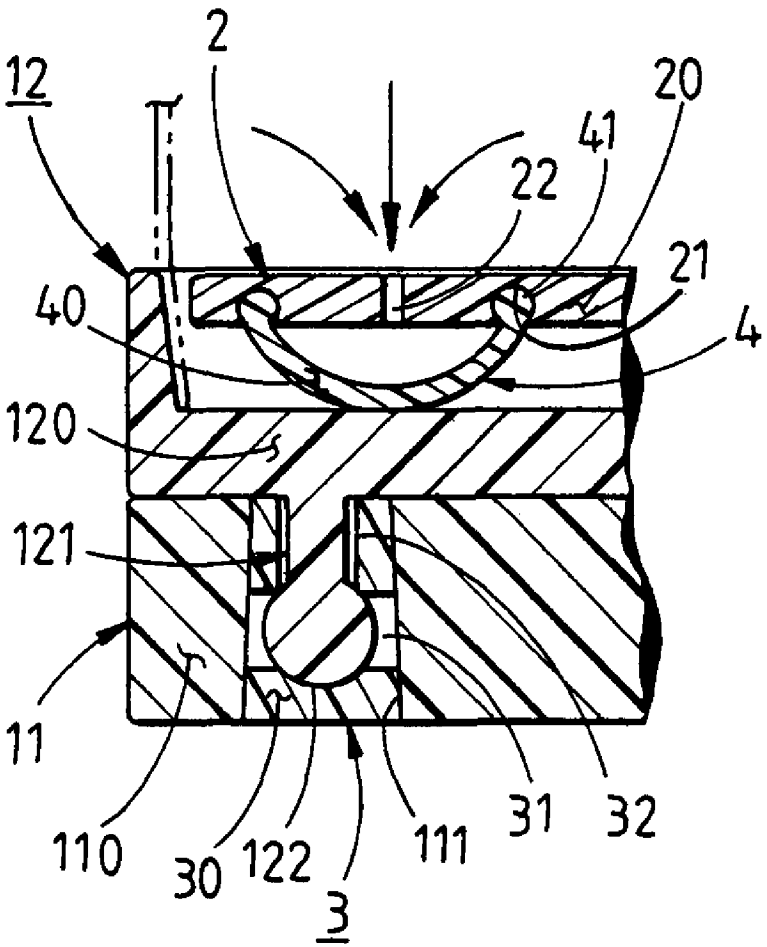
FIG. 3 is a magnified view showing the vertical section of the part of upper sole and lower sole locking to each other and the part of ladle discs of insole, and the diagram of insole performing air blowing.

Referring to FIG. 1, the shoe sole 1 of the invention comprises a lower sole 11 and an upper sole 12. The uppersurface of upper sole 12 is lined with an insole 2. The detailed structures of each parts are as shown in FIG. 2, where the lower sole 11 has a plate body 110 made of synthetic resin material and disposed with a plurality of through-holes 111 spaced apart thereon, and consists of a plurality of lock plugs 3 made of rubber or semi-flexible plastic material, which are respectively inserted in the through-holes (as shown in FIG. 3 and FIG. 4). The upper sole 12 has a plate body 120 made of synthetic resin material and having the same number of lock bars 121 extendingly disposed on its undersurface at places corresponding to the through-holes 111 on lower sole 11.

When assembling the sole 1 of the invention, directly laminate the upper sole 12 over the lower sole 11, and insert each lock bar 121 on the upper sole plate body 120 into the corresponding through-hole 111 on the lower sole plate body 110, and then plug in from bottom up a lock plug into each of the through-holes 111 to secure the lock bars 121 to complete the assembly of a sole 1 with readily replaceable lower sole 11.

After wearing the shoes made with the sole 1 of the invention as shown in FIG. 1 for a while, the lower sole 11 should be replaced when it shows sign of wear. When that happens, wearer only needs to in sequence remove each lock plug 3 from the lower sole 11 to separate the worn lower sole 11 from the upper sole 12 and discard it, and then attach a new lower sole 11 in a manner described above, and insert back the old lock plugs 3 or new lock plugs 3 into each through-hole 111 on the new lower sole plate body 111 to complete the job. The whole process is easy and quick without the use of adhesive or hand sewing, and doable by the consumers themselves.

The detailed structures of the insole 2 of the invention is as shown in FIG. 2, where the insole 2 comprises a plate body 20 made of synthetic resin material and disposed with a plurality of groove rings 21 spaced part on its undersurface, and a small through-hole 22 is configured at the center location of each groove ring 21. The insole 2 also comprises a plurality of ladle discs 4 respectively secured in the groove rings 21 with glue or adhesive to form an insole 2 with a plurality of air pockets. When a shoe as shown in FIG. 1 is lined with an insole 2 of the invention, in the instant of each "treading" movement, the plurality of air-sac like ladle discs 4 on the undersurface of the plate body 20 of insole 2 are treaded flat as shown in FIG. 4. The air in the disc body 40 is pressed and ejected inside the shoes in the direction of the arrow. In the instant the foot is "lifted", the air-sac like ladle discs 4 automatically restore to original shape, as shown in FIG. 3. Such continuous alternation of treading and lifting during walking causes air convection in the shoes lined with an insole 2 herein, giving the feet a fresh, cool, dry and comfortable feel, even when the sole of the foot perspires and accumulates sweat in the shoes.

Again referring to FIGS. 2, 3 and 4, to make sure each lock bar 121 on the undersurface of the upper sole plate body 120 of sole 1 securely engages each lock plug 3 on the lower sole plate body 110 without loosening, the lock bar 12 is designed into a bar having a ball-shape protrusion of larger diameter 122 or a protruding ring of larger diameter at the end. The lock plug in correspondence is designed as a column 30 with a transverse through-hole 31, and a cylindrical pit 32 is configured at the center of the uppersurface of column 30, which communicates with the transverse through-hole 31. As such, when a lock bar 121 engages a lock plug 3, the lock bar 121 is inserted into the cylindrical pit 32 at the uppersurface of the lock plug column 30 to reach the transverse through-hole 31 on column 30 and secured therein without loosening or dislodging. As a result, the shoe sole 1 of the invention is assembled firmly into one piece without separation or dislodging after the plurality of lock bars 121 of upper sole 12 join the plurality of corresponding lock plugs 3 on lower sole 11.

To prevent the lock plugs 3 disposed in the through-holes 111 on lower sole plate body 110 from upward displacement after they engage the lock bars 121 of upper sole plate body 120, the column 30 of lock plug 3 may be designed into a tapered column bigger at the bottom and smaller at the top, and the through-holes 111 may correspondingly be designed into tapered through-holes smaller at the top and bigger at the bottom. In addition, to make it easier to glue each ladle disc to the groove ring 21 on the undersurface of plate body 20 of insole 2, the marginal edge of the disc body 40 of ladle disc 4 is disposed with a convex ring 41, 41*a* or 41*b* so each ladle disc can be securely embedded in the groove ring 21 via the convex ring 41 on its disc body 40, and fixated with glue or adhesive without slightest movement or loosening. The convex rings 41, 41*a*, 41*b* may be designed into convex rings 41, 41*a*, 41*b* of several (at least three) different heights. Ladle discs 4 having higher (or thicker) convex rings 41*a* or 41*b* are installed over groove rings 21 on the left or right side of the heel part of insole plate body 21, while the rest of the insole plate body 21 are installed with ladle discs 41 having shortest (or thinnest) convex rings to offset and balance the part on the left or right side of the heel part of lower sole 11 that is prone to wear, thereby giving the wearer a stable and comfortable feel when walking and extending the service life of sole 1.

The invention claimed is:

1. A shoe sole and insole structure, characterized in which the insole comprising a plate body disposed with a plurality of groove rings on its undersurface and having a small through-hole at a center location of each groove ring, and further comprising a plurality of ladle discs respectively glued in the groove rings to form an insole with a plurality of air pockets.

2. A shoe sole and insole structure as claimed in claim 1, characterized in which the ladle disc being disposed with a convex ring at a marginal edge of a disc body.

3. A shoe sole and insole structure as claimed in claim 2, characterized in which convex rings at the marginal edge of the disc body of ladle discs being designed with several different heights, where ladle discs having higher (or thicker) convex rings are installed over groove rings on the left or right side of the heel part of insole plate body to offset and balance the part on the left or right side of the heel part of lower sole that is prone to wear.

4. A shoe sole and insole structure, characterized in which the sole comprises an upper sole and a lower sole, wherein the lower sole comprising a plate body having a plurality of through-holes spaced part thereon and containing a plurality of lock plugs which are respectively plugged into the through-holes;

the upper sole comprising a plate body having an undersurface with a plurality of lock bars extendingly disposed with the same number of lock bars on its undersurface at the place corresponding to the through-holes on the lower sole;

the upper sole directly laminating over the lower sole, each lock bar on the upper sole plate body being respectively inserted into each through-hole on lower sole plate body, and the lock plugs being respectively inserted into the through-holes and locking the lock bars to form a shoe sole.

5. A shoe sole and insole structure as claimed in claim 4, characterized in which each lock bar on the undersurface of upper sole plate body of the sole being designed into a bar with a ball-shaped protrusion of larger diameter or protruding ring of larger diameter at the end, the lock plug being designed with a column having a transverse through hole thereon and a cylindrical pit being configured at the center of the uppersurface of column, which communicates with the transverse through-hole; the lock bar being inserted into the cylindrical pit on the uppersurface of the lock plug column and secured at the transverse through-hole.

6. A shoe sole and insole structure as claimed in claim 4, characterized in which the through-holes on the lower sole plate body being designed into tapered through-holes smaller at the top and bigger at the bottom.

7. A shoe sole and insole structure as claimed in claim 4, characterized in which the column of lock plugs being designed into tapered column bigger at the bottom and smaller at the top.

* * * * *